US005536313A

United States Patent [19]

Watanabe et al.

[11] Patent Number: 5,536,313

[45] Date of Patent: Jul. 16, 1996

[54] INTERMITTENT COATING APPARATUS

[75] Inventors: Masaru Watanabe, Nishinomiya; Tsumoru Ohata, Kyoto, both of Japan

[73] Assignee: Matsushita Electric Industrial Co., Ltd., Osaka, Japan

[21] Appl. No.: 299,609

[22] Filed: Sep. 1, 1994

[30] Foreign Application Priority Data

Sep. 6, 1993 [JP] Japan ..... 5-220971

[51] Int. Cl.[6] ..... B05B 13/02; B05B 3/16

[52] U.S. Cl. ..... 118/303; 118/324; 239/106; 239/119; 222/318

[58] Field of Search ..... 118/410, 419, 118/300, 303, 305, 307, 324; 239/104, 119, 124, 106; 222/318, 424

[56] References Cited

U.S. PATENT DOCUMENTS

| | | | |
|---|---|---|---|
| 3,875,893 | 4/1975 | Riley et al. | 118/710 |
| 4,687,137 | 8/1987 | Boger et al. | 239/124 |
| 4,889,069 | 12/1989 | Kawakami | 118/50 |
| 5,263,504 | 11/1993 | Bailey et al. | 134/176 |
| 5,423,482 | 6/1995 | Mueller et al. | 239/1 |

FOREIGN PATENT DOCUMENTS

| | | |
|---|---|---|
| 62-266157 | 11/1987 | Japan . |
| 299166 | 4/1990 | Japan . |
| 494589 | 3/1992 | Japan . |

*Primary Examiner*—Donald E. Czaja
*Assistant Examiner*—Calvin Padgett
*Attorney, Agent, or Firm*—Renner, Otto, Boisselle & Sklar

[57] ABSTRACT

An intermittent coating apparatus for intermittently coating a continuously running base member with a coating material includes a nozzle for discharging the coating material toward the base member and an absorption unit for controlling a flow of the coating material. The nozzle has a slit opened toward the base member and a manifold connected to the slit. The absorption unit includes a head having an inlet, an outlet, and a passage connecting the inlet and the outlet. The head is located in a housing. The absorption unit also includes a driving unit for sliding the head in the direction of a shaft located in the housing. By the sliding operation of the head, an absorption space is formed between an end face of the head and the manifold. In order to stop the coating operation, the supply of the coating material from an external supply opening to the inlet of the head is stopped by the sliding movement of the head. The sliding movement of the head also causes the coating material remaining in the nozzle to be absorbed into the absorption space. As a result, there is no coating material remaining between the nozzle and a roller provided for causing the base member to run. Accordingly, the coating material is not pulled out to the base member when the supply of the coating is stopped, and thus the leading edge and the trailing edge of coated areas of the base member can be straight lines.

8 Claims, 8 Drawing Sheets

INTERMITTENT COATING APPARATUS

BACKGROUND OF THE INVENTION

1. Field of the Invention

The present invention relates to an intermittent coating apparatus for intermittently coating a continuously running base member with a coating material.

2. Description of the Related Art

An apparatus for intermittently coating a base member (i.e. an external coating target), which is continuously running, with a coating material such as an adhesive or a paint is known and described in, for example, Japanese Laid-Open Patent Publication No. 62-266157.

Briefly referring to FIG. 11, a typical structure of a conventional intermittent coating apparatus 800 will be described. FIG. 11 is a cross sectional view of the intermittent coating apparatus 800.

By the intermittent coating apparatus 800, a coating material is discharged through a slit 27 formed at a tip of a nozzle 26 and is applied to a continuously running base member 32. The intermittent coating operation is controlled in the following manner by the movement of a shaft 30 directly connected to an air cylinder 22. The movement of the shaft 30 in the direction of arrow B or the opposite direction is controlled by the flow of the air supplied through an air supply pipe 28.

In order to coat the base member 32 with the coating material, the shaft 30 is retracted in the direction opposite to arrow B. The coating material which is sent to a supply chamber 24 through a pipe 29 by a liquid supply device such as a pump is further sent to the slit 27 through a supply opening 31, and then is discharged through the slit 27 to be applied to the base member 32. In order to stop the coating operation, the air cylinder 22 is driven to move the shaft 30 in the direction of arrow B in order to cover the supply opening 31 with a head 25, thereby stopping the supply of the coating material to the slit 27. By driving the air cylinder 22 so as to alternately open and close the supply opening 31 in repetition, the base member 32 is coated with the coating material intermittently.

The intermittent coating apparatus 800 having the above-described structure is generally used to put the coating material on the base member 32 in a small amount such as several tens of cubic centimeters per square meter, or less. In the case that the intermittent coating apparatus 800 is used to coat the base member 32 with the coating material in a relatively large amount such as 100 cc/m$^2$ or more, the leading edge and the trailing edge of areas of the base member 32 coated with the coating material are likely not to be clear, straight lines.

Such areas are schematically illustrated in FIG. 12. In FIG. 12, the base member 32 is running in the direction of arrow C. Reference numeral 20 denotes areas coated with the coating material on the base member 32 (referred to as coated areas hereinafter). As is illustrated in FIG. 12, a trailing edge 19 of each of the coated areas 20 is not a clear, straight line. Accordingly, a leading edge 21 of the respective following coated areas 20 is not a clear, straight line, either. Such a phenomenon occurs because the coating material existing between the nozzle 26 and the base member 32 or in the slit 27 of the nozzle 26 is unnecessarily pulled out onto the base member 32.

Especially in the case that the coating material in use tends to rope, the coating material in the slit 27 is easily pulled out by the running movement of the base member 32 even after the supply of the coating material to the slit 27 is stopped.

Further, in the intermittent coating apparatus 800, the shaft 30 for connecting the head 25 and the air cylinder 22 is supported only by a bearing portion 23. Due to such a structure, in the case that the forming precision of the shaft 30 and/or the bearing portion 23 is not sufficiently precise to properly align the head 25 and the supply opening 31, the supply opening 31 cannot be completely covered with the head 25. In such a case, the coating material possibly goes into the slit 27 through a slight gap around the supply opening 31 incompletely covered with the head 25, even after the shaft 30 is moved to such a position as to cover the supply opening 31 with the head 25. This also spoils the linearity of the leading edge 21 and the trailing edge 19 of the coated areas 20.

SUMMARY OF THE INVENTION

According to one aspect of the invention, the intermittent coating apparatus for intermittently coating an external coating target with a coating material includes: a nozzle for discharging the coating material toward the coating target; supply control means for alternately providing and stopping a flow of the coating material to the nozzle; and absorption control means for absorbing the coating material remaining in the nozzle to a prescribed space when a supply of the coating material stops and for returning the coating material from the prescribed space into the nozzle when the supply of the coating material starts.

According to another aspect of the invention, the intermittent coating apparatus for intermittently coating an external coating target with a coating material includes: a nozzle for discharging the coating material toward the coating target, the nozzle having therein a slit opened toward the coating target and a manifold connected to the slit; a head slidable along a guide until an end face thereof reaches the manifold to control a flow of the coating material to the nozzle, the head having an inlet, an outlet, and a passage connecting the inlet and the outlet; and a driving unit for controlling the sliding movement of the head, wherein the inlet of the head is connected to an external supply opening to supply the coating material to the nozzle via the inlet, the passage and the outlet of the head, in order to coat the coating target with the coating material, and the head slides to close the external supply opening with a side wall of the head to thereby stop the supply of the coating material and also to form an absorption space to thereby absorb the coating material remaining in the nozzle into the absorption space, in order to stop coating.

Thus, the invention described herein makes possible the advantage of providing an intermittent coating apparatus for intermittently coating an external coating target with a coating material which allows a leading edge and a trailing edge of each of coated areas of a continuously running base member to be straight lines even in the case that the coating material is supplied in a large amount such as 100 cc/m$^2$ or more.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

Example 1

Figure 1:
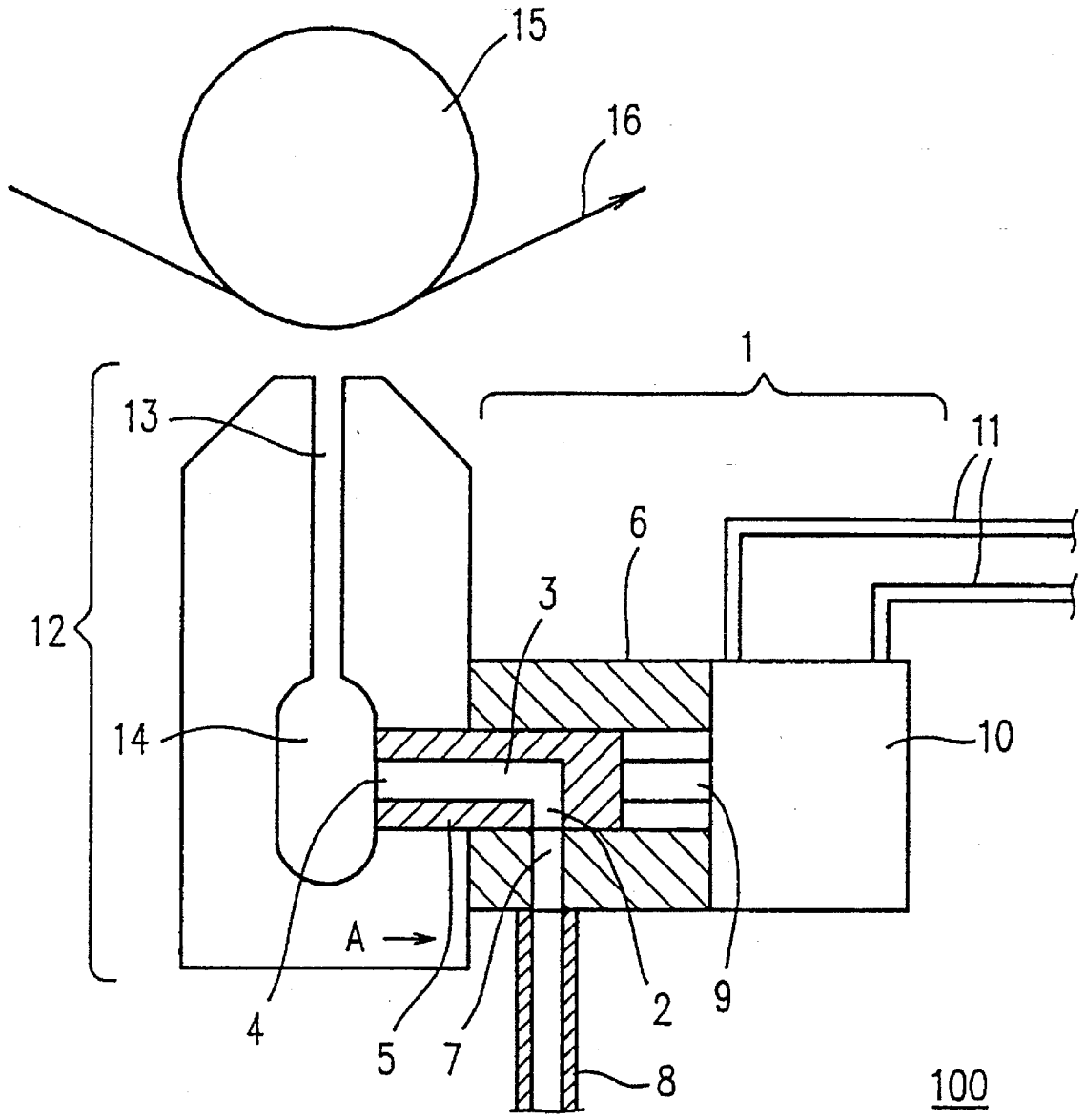
FIG. 1 is a cross sectional view showing an intermittent coating apparatus in accordance with a first example of the present invention in the state of performing the coating operation.
Figure 2:
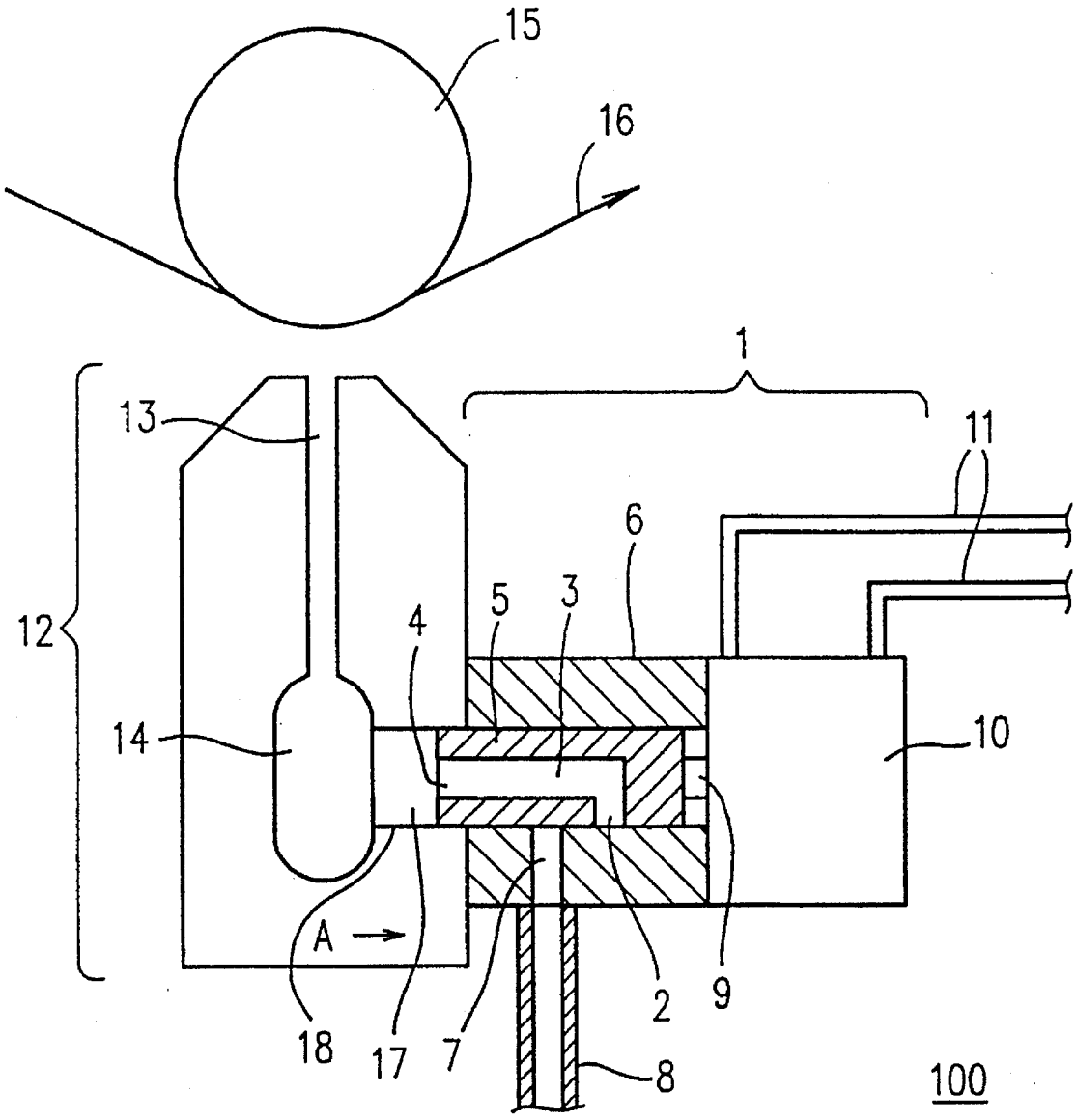
FIG. 2 is a cross sectional view showing the intermittent coating apparatus shown in FIG. 1 in the state where the coating operation is stopped.

With reference to FIGS. 1, 2, 7 and 8, an intermittent coating apparatus 100 in accordance with a first example of the present invention will be described. The intermittent coating apparatus 100 is used to coat a base member 16, supported and continuously run by a roller 15, with a paint. FIG. 1 is a cross sectional view of the intermittent coating apparatus 100 in the state of performing the coating operation, and FIG. 2 is a cross sectional view of the intermittent coating apparatus 100 in the state where the coating operation is stopped. The same reference numerals are used to designate the same components in both figures.

As is shown in FIGS. 1 and 2, the intermittent coating apparatus 100 includes a nozzle 12 and an absorption unit 1 for absorbing a paint.

The nozzle 12 has a slit 13 opened toward the base member 16 and a manifold 14 connected to the slit 13. The manifold 14 accommodates the paint therein. The absorption unit 1 includes a head 5 movable in the direction of arrow A and the opposite direction, a housing 6 for accommodating the head 5, and an air cylinder 10 located rear (right in FIGS. 1 and 2) to the housing 6 as driving means for driving the head 5. The air cylinder 10 and the head 5 are connected to each other via a shaft 9. The head 5 slides along a guide (not shown) in the housing 6 by the movement of the air cylinder 10.

The nozzle 12 has an opening 18 (FIG. 2) extended from a side wall thereof to the manifold 14, the opening 18 being located at a position corresponding to the housing 6. The opening 18 has such a size and shape as to partially accommodate the head 5. The head 5 sliding along the guide in the direction opposite to arrow A slides into the opening 18 until an end face of the head 5 reaches the manifold 14 to contact the paint in the manifold 14 as is illustrated in FIG. 1.

When the head 5 moves in the direction of arrow A, an absorption space 17 (FIG. 2) is formed in the opening 18. An outer face of the head 5 is slidable with respect to an inner face of the housing 6 and the opening 18.

The air cylinder 10 is driven by the flow of the air supplied through air pipes 11. The direction of the air flow is switched by an electromagnetic valve (not shown) connected to an end (not shown) of each of the air pipes 11, and thus the direction of the movement of the air cylinder 10 is changed, thereby switching the direction of the movement of the head 5.

The housing 6 has a supply opening 7. A pipe 8 for supplying the paint from outside is attached to the housing 6 at a position corresponding to the supply opening 7. The head 5 has an outlet 4 in the end face thereof and an inlet 2 in a side wall thereof. The outlet 4 is connected to the manifold 14 in the nozzle 12. The inlet 2 is connected to the supply opening 7 in the housing 6 when the head 5 is at the position shown in FIG. 1. The head 5 further has a passage 3 for connecting the inlet 2 and the outlet 4.

The intermittent coating apparatus 100 operates in the following manner.

As is mentioned above, FIG. 1 shows the state where the coating operation is performed. The paint is supplied through the pipe 8 and flows through the supply opening 7, the inlet 2, the passage 3, and the outlet 4 to be supplied to the manifold 14 in the nozzle 12. Then, the paint flows through the slit 13 and is applied to the base member 16 in the state of being expanded in the direction of the width of the base member 16 perpendicular to the running direction thereof.

FIG. 2 shows the state where the coating operation is stopped. In order to stop the coating operation, the head 5 slides in the direction of arrow A. Due to such a position of the head 5 as illustrated in FIG. 2, the supply opening 7 is closed by the side wall of the head 5, thereby preventing the supply of the paint to the nozzle 12.

By the above-mentioned sliding movement of the head 5 in the direction of arrow A, the absorption space 17 is formed in the opening 18. Due to the negative pressure produced in the absorption space 17 while the head 5 slides away, the paint remaining in the slit 13 and the manifold 14 is absorbed into the absorption space 17 in an amount corresponding to the distance by which the head 5 moves, namely, the volume of the absorption space 17 formed. In accompaniment with the absorption of the paint into the absorption space 17, the paint remaining between a tip of the nozzle 12 and the base member 16 is also absorbed into the slit 13. As a result, a gap between the nozzle 12 and the base member 16 is free from the paint. In such a state, no paint is pulled out to the base member 16 when the supply of the paint is stopped, and thus the leading edge and the trailing edge of each of the coated areas of the base member 16 can be straight lines.

In order to resume the supply of the paint, the head 5 moves in the direction opposite to arrow A to realize the state shown in FIG. 1. The supply opening 7 is aligned with the inlet 2, thereby providing the paint from the pipe 8 to the nozzle 12. The paint in the absorption space 17 is also moved back into the nozzle 12, which facilitates the start of the coating operation.

Figure 7:
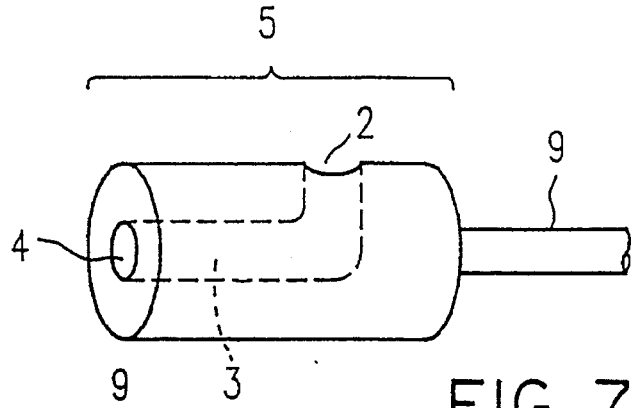
FIG. 7 is a schematic view showing an example of a head used in the intermittent coating apparatus of the present invention.

FIG. 7 shows a schematic view of an example of the head 5. The head 5 in FIG. 7 is cylindrical and has the inlet 2, the outlet 4, and the passage 3. The shaft 9 is located rear to the head 5.

The head 5 has a diameter, preferably, in the range of 2 mm to 100 mm. The inner diameter of the passage 3 and the other passages through which the paint flows are suitably selected in accordance with the amount of the paint to be applied to the base member 16 and the viscosity of the paint, but is typically in the range of 0.5 mm to 90 mm.

Figure 8:
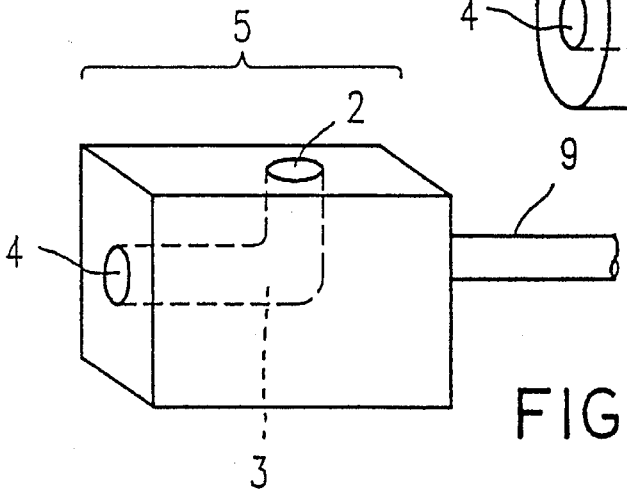
FIG. 8 is a schematic view showing another example of a head used in the intermittent coating apparatus of the present invention.

The head 5 may have other shapes such as a rectangular pillar as is shown in FIG. 8.

As is shown in FIGS. 1 and 2, the nozzle 12 and the roller 15 have the gap therebetween. The width of the gap is preferably set to be from substantially the same size to twice as large as the thickness of a coat of the paint applied to the base member 16 in the state of being wet. Accordingly, the width of the gap is suitably adjusted based on the thickness of the coat of the paint. For example, when the amount of the paint to be applied to the base member 16 is 100 cc/m$^2$ or more, the width of the gap is usually required to be 0.05 mm or more. Providing such a gap restricts the paint from being pulled out and applied to the base member 16 when the supply of the paint is stopped, even if the paint tends to rope.

It is important that the paint should not leak from the sliding interface between the head 5 and the housing 6 and the sliding interface between the head 5 and the opening 18 in order to improve the performance of the intermittent coating apparatus 100. Although not shown in the figures, a sealing member such as a ring-shaped packing may be used, or the clearance between the head 5 and the housing 6 and the clearance between the head 5 and the opening 18 may be reduced as much as possible. The outer face of the head 5 may be subjected to an abrasion resistant processing such as ceramic coating in order to improve the resistance against abrasion of the head 5.

Figure 9:
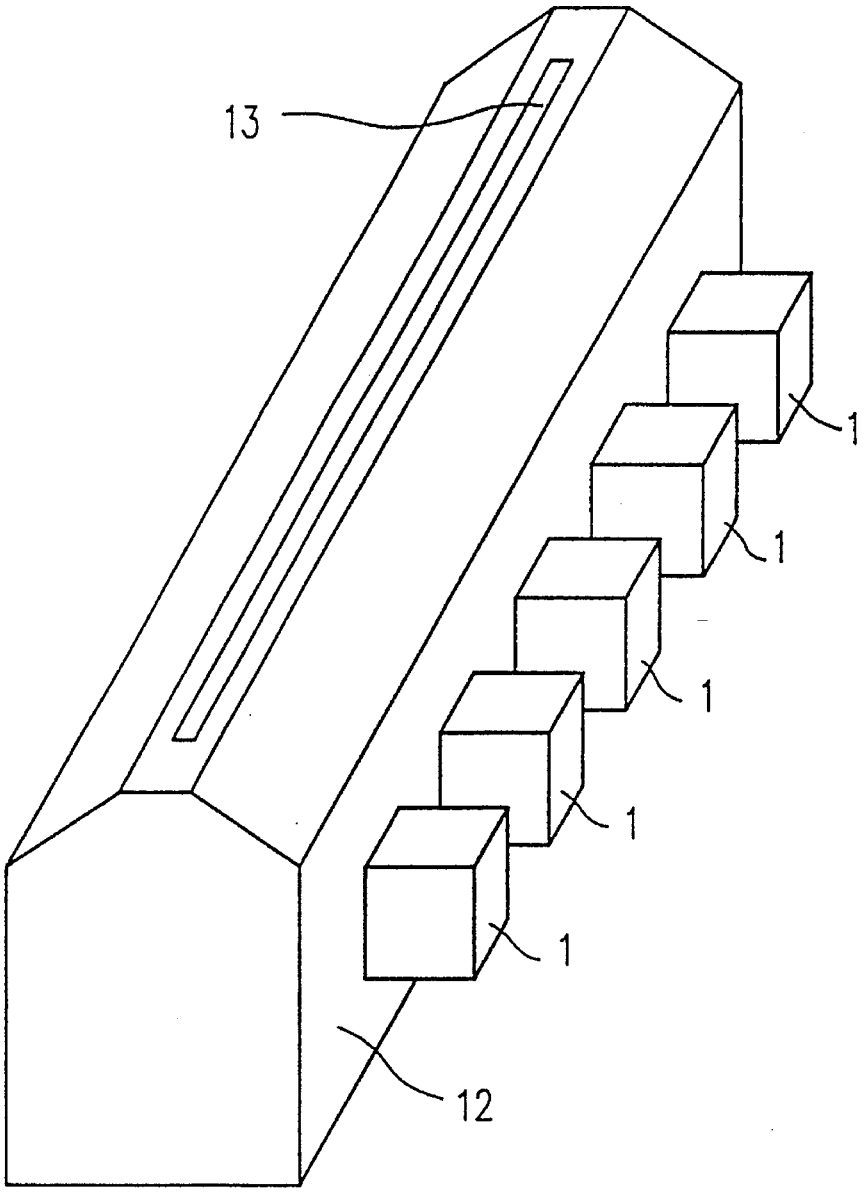
FIG. 9 is a schematic view showing a nozzle and absorption units of an intermittent coating apparatus in accordance with another example of the present invention.

A plurality of absorption units 1 may be provided for one nozzle 12 in accordance with the width of the base member 16 to be coated with the paint. FIG. 9 illustrates an example of such a combination of the nozzle 12 and a plurality of absorption units 1. In FIG. 9, five absorption units 1 are provided for one nozzle 12 having a slit 13. The number of the absorption units to be provided is suitably selected in accordance with the amount and the viscosity of the paint to be used and the width of the base member 16 to be coated with the paint. For example, in the case that the base member 16 is coated with the paint having a viscosity of 10 poise in an amount of 100 cc/m$^2$ one absorption unit 1 is sufficient for a width of approximately 100 mm, but it is preferable to provide approximately five absorption units 1 as is shown in FIG. 9 for a width of approximately 1000 mm.

A typical results the coating operation using the intermittent coating apparatus 100 will be described.

In the following example, the base member 16 is coated with a paint having a viscosity of 20 poise under the conditions that the head 5 has a diameter of 10 mm, the passage 3 and the other passages through which the paint flows has an inner diameter of 5 mm, the moving rate of the head 5 is 20 mm/sec., and the coating rate is 10 m/min. Then, the coating operation is stopped for 0.5 second and is performed for five seconds in repetition. The width for coating is set to be 100 mm, and the amount of the paint is set to be 100 cc/m$^2$.

Figure 10:
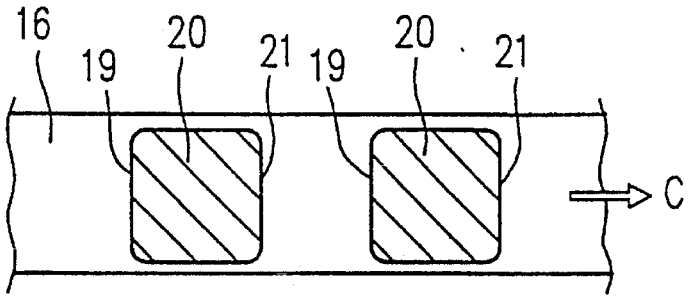
FIG. 10 is a schematic view showing a typical result of a base member coated with a coating material using the intermittent coating apparatus of the present invention.
Figure 11:
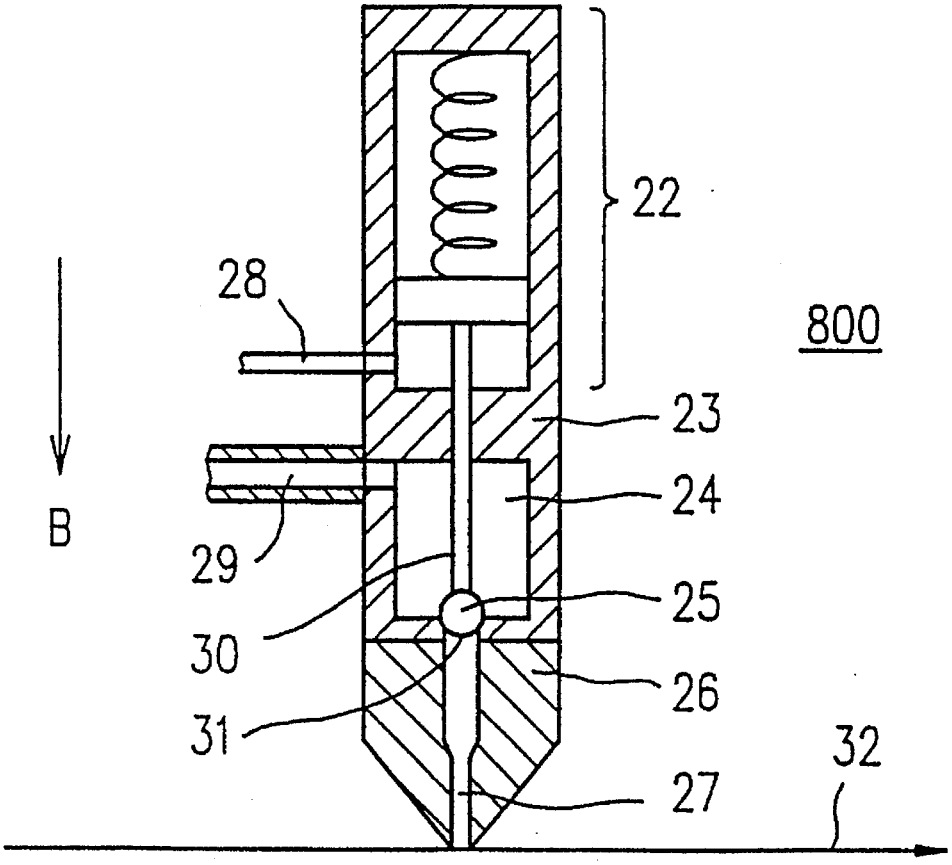
FIG. 11 PRIOR ART
FIG. 11 is a cross sectional view showing a typical conventional intermittent coating apparatus.
Figure 12:
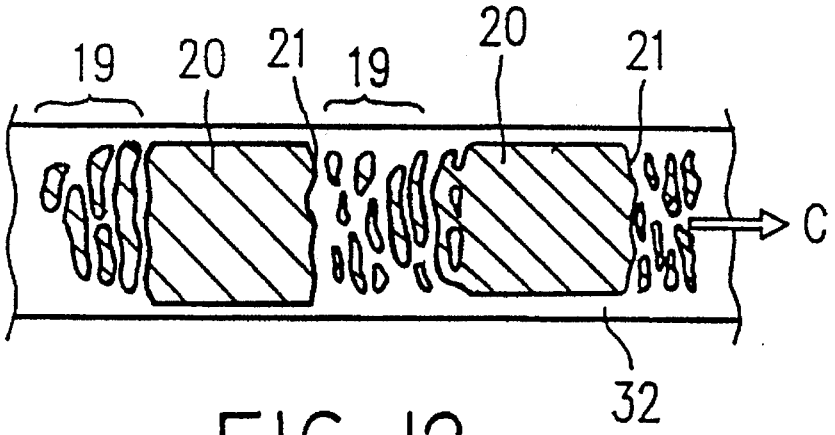
FIG. 12 PRIOR ART
FIG. 12 is a schematic view showing a typical result of a base member coated with a coating material using the conventional intermittent coating apparatus.

FIG. 10 schematically shows the base member 16 obtained in this manner. The leading edge 21 and the trailing edge 19 of each of the coated areas 20 are clear, straight lines. As a result, each of the whole coated areas 20 elongating from the leading edge 21 to the trailing edge 19 thereof can be used as a product.

The moving rate and the moving distance of the head 5 are suitably selected in accordance with the coating rate, the length of the base member 16 to be coated, and the length of the distance between two adjacent coated areas on the base member 16. Typically, the moving rate of the head 5 is set to be 1 to 500 mm/sec., and the moving distance of the head 5 is set to be 0.1 to 100 mm.

The inventors of the present invention have found that, in an intermittent coating apparatus according to the present invention, the operation for absorbing the paint remaining in the nozzle 12 into the absorption space 17 by the movement of the head 5 generates a force acting on the paint in the direction shearing the paint. It has also been found that particles, which may exist in a certain kind of paint such as a magnetic paint used in a magnetic tape or the like and which tend to aggregate, are re-dispersed by such a force.

Example 2

Figure 3:
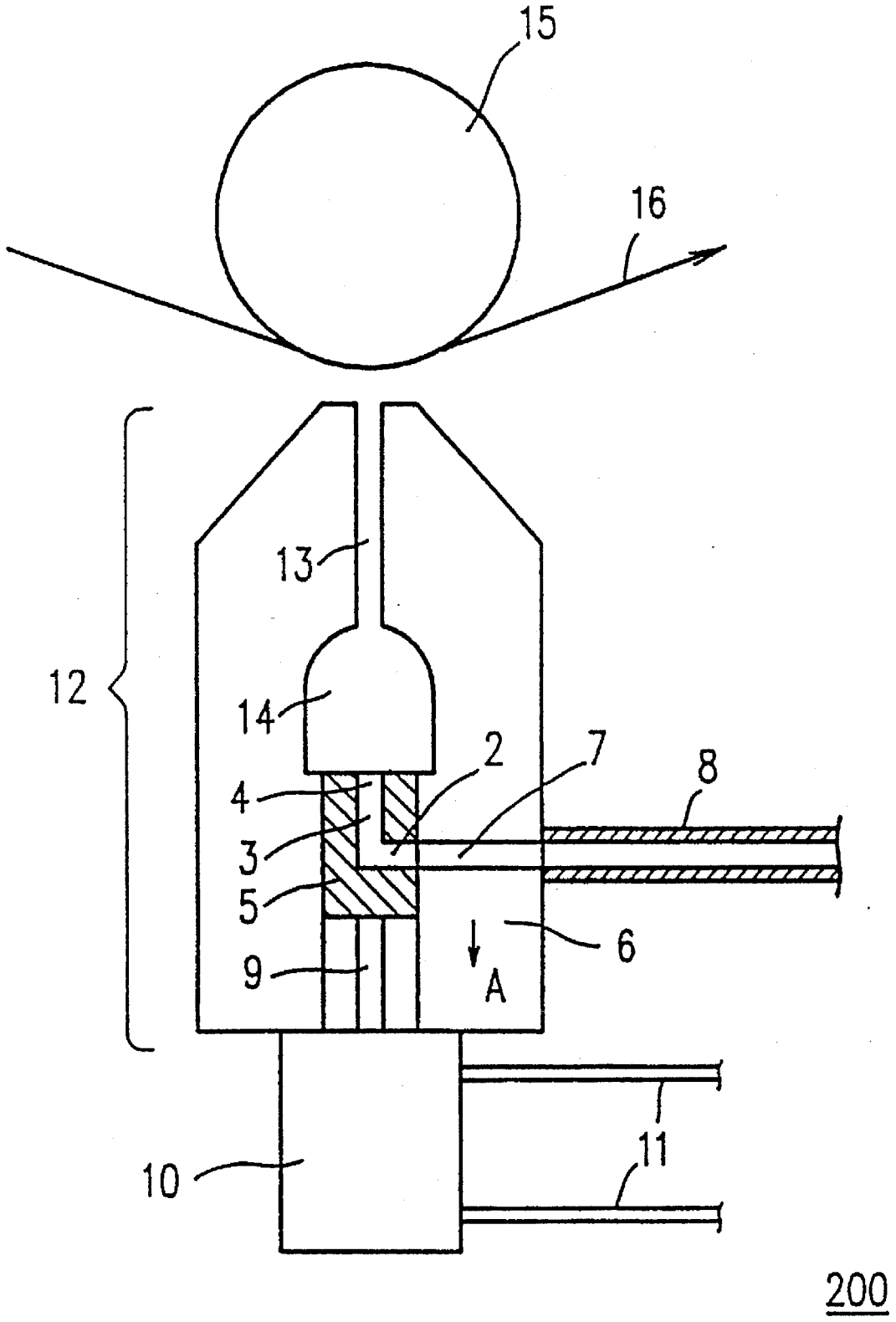
FIG. 3 is a cross sectional view showing an intermittent coating apparatus in accordance with a second example of the present invention in the state of performing the coating operation.
Figure 4:
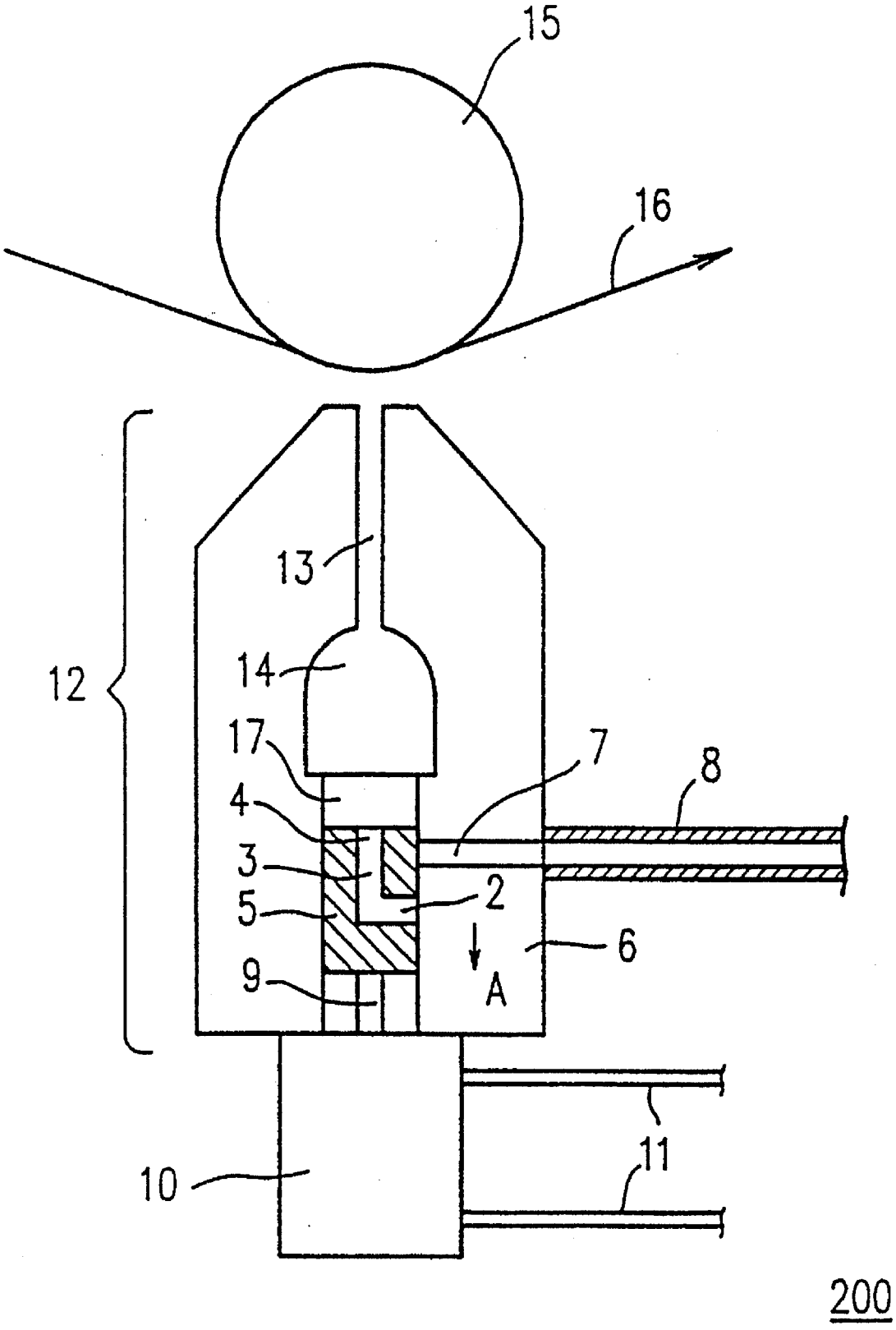
FIG. 4 is a cross sectional view showing the intermittent coating apparatus shown in FIG. 3 in the state where the coating operation is stopped.

Referring to FIGS. 3 and 4, an intermittent coating apparatus 200 in a second example according to the present invention will be described. Identical elements as those in the first example bear identical reference numerals therewith, and the explanation thereof is omitted. FIG. 3 is a cross sectional view of the intermittent coating apparatus 200 in the state of performing the coating operation, and FIG. 4 is a cross sectional view of the intermittent coating apparatus 200 in the state where the coating operation is stopped.

The intermittent coating apparatus 200 is different from the intermittent coating apparatus 100 in accordance with the first example in that the elements located in the housing 6 in the intermittent coating apparatus 100 are located in the nozzle 12 in the intermittent coating apparatus 200. In detail, in the intermittent coating apparatus 200, the head 5 is located in the nozzle 12, and the nozzle 12 thus acts as a housing for accommodating the head 5. In accordance with such a structure, the guide along which the head 5 slides is also located in the nozzle 12. The nozzle 12 has the supply opening 7 in a side wall thereof. The air cylinder 10 for driving the head 5 is located rear to (below in FIGS. 3 and 4) the nozzle 12. As in the first example, the absorption space 17 is formed when the head 5 slides in the direction of arrow A.

Since the housing 6 can be eliminated due to such a structure, the production cost can be reduced.

The intermittent coating apparatus 200 operates in substantially the same manner as in the intermittent coating apparatus 100, and has the same functions therewith. The same effects such as the straight leading and trailing edges of the coated areas of the base member 16 are also obtained.

Example 3

Figure 5:
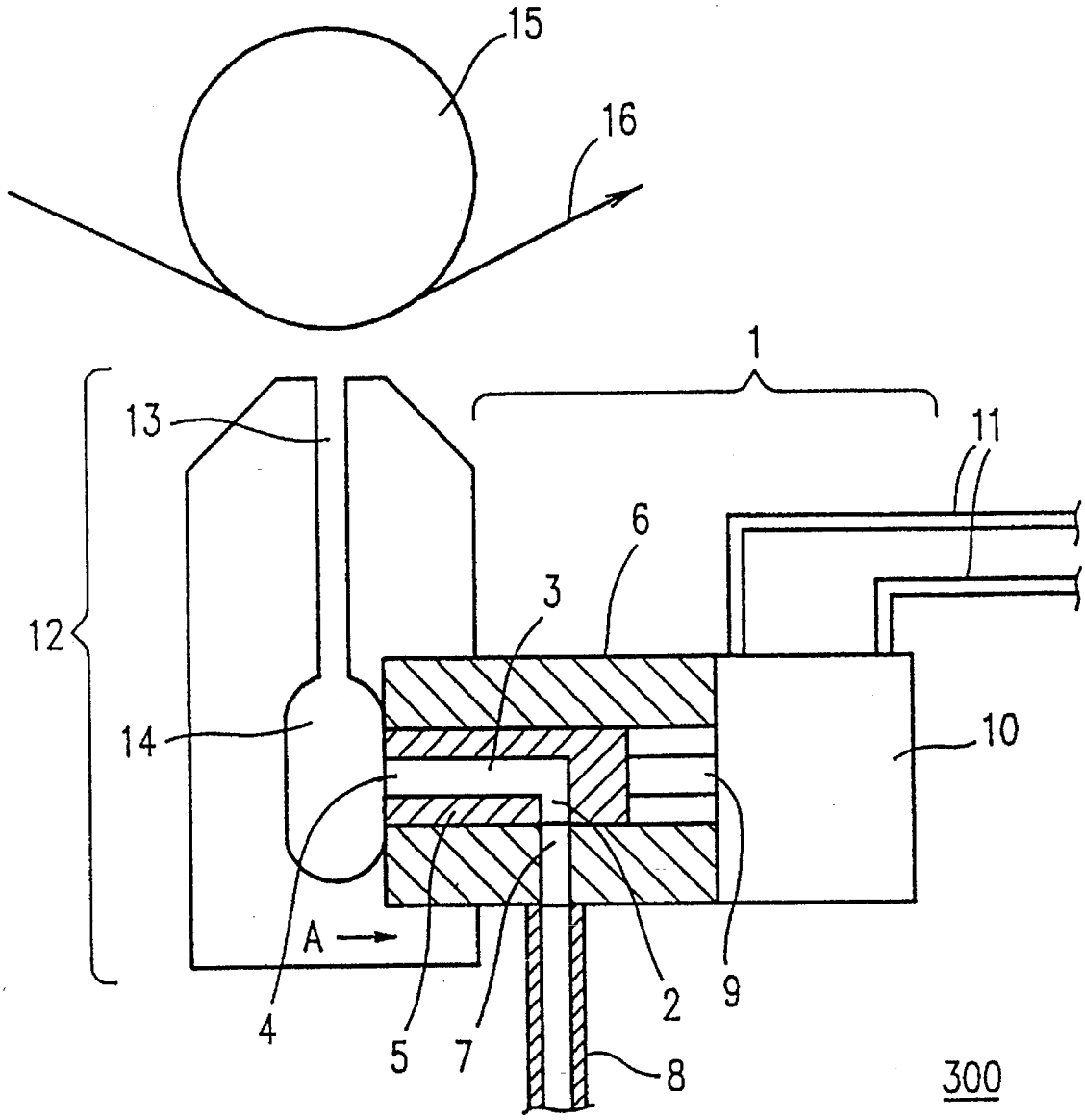
FIG. 5 is a cross sectional view showing an intermittent coating apparatus in accordance with a third example of the present invention in the state of performing the coating operation.
Figure 6:
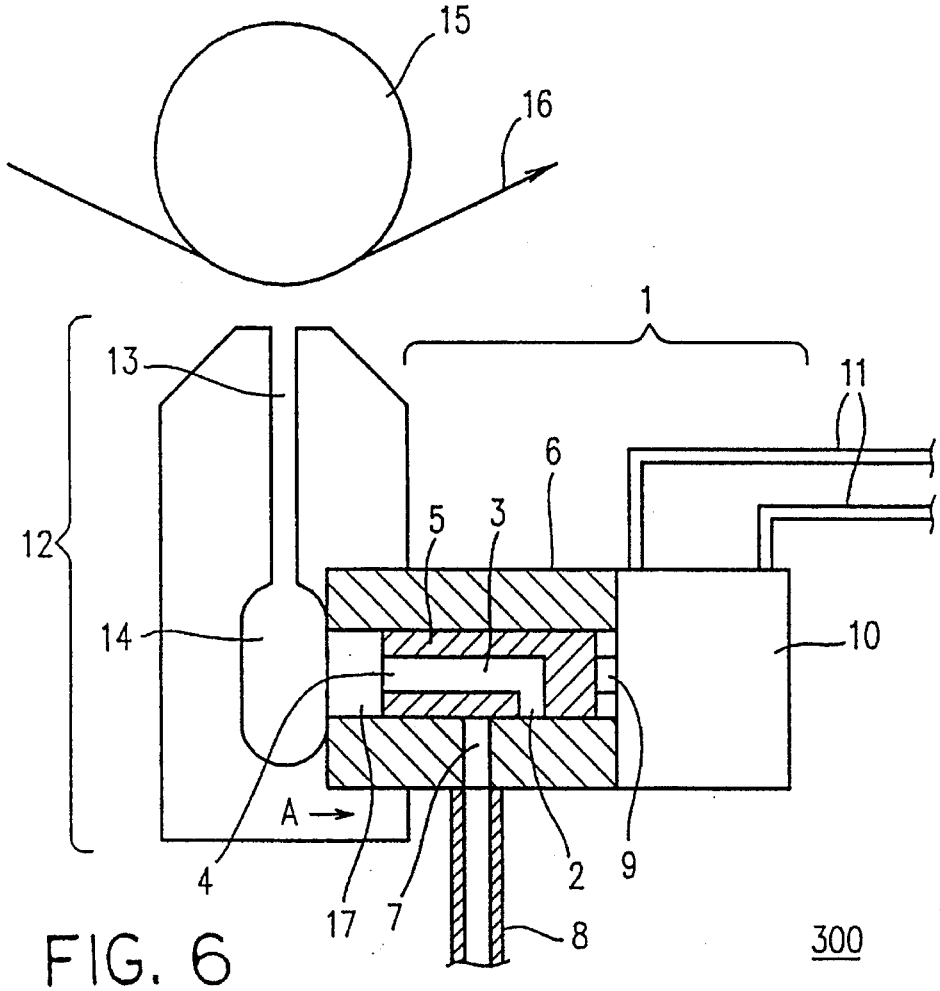
FIG. 6 is a cross sectional view showing the intermittent coating apparatus shown in FIG. 5 in the state where the coating operation is stopped.

Referring to FIGS. 5 and 6, an intermittent coating apparatus 300 in a third example of the present invention will be described. Identical elements as those in the first example bear identical reference numerals therewith, and the explanation thereof is omitted. FIG. 5 is a cross sectional view of the intermittent coating apparatus 300 in the state of performing the coating operation, and FIG. 6 is a cross sectional view of the intermittent coating apparatus 300 in the state where the coating operation is stopped.

The intermittent coating apparatus 300 is different from the intermittent coating apparatus 100 in accordance with the first example in that the housing 6 is partially accommodated in the nozzle 12. In such a structure, the head 5 slides only within the housing 6 in the direction of arrow A and the opposite direction. Accordingly, the opening 18 for accommodating the head 5 when the head 5 goes into the nozzle 12, as required in the first example, can be eliminated. The absorption space 17 is formed in the housing 6 when the head 5 slides in the direction of arrow A.

While the opening 18 in the nozzle 12 and the head 5 are required to be accurately aligned with each other (for example, by aligning the center of the both) in the intermittent coating apparatus 100, such alignment is not necessary in the intermittent coating apparatus 300. Accordingly, maintenance work becomes easier. Even if the absorption unit 1 accidentally becomes out of order during the production or in use, the absorption unit 1 can be replaced with a new one quickly and easily.

The intermittent coating apparatus 300 is operated in substantially the same manner as in the intermittent coating apparatus 100 and has the same functions therewith. The same effects such as the straight leading and trailing edges of the coated areas of the base member 16 are also obtained.

As has been described so far, an intermittent coating apparatus according to the present invention includes a nozzle and an absorption unit. The absorption unit includes a head having an inlet, an outlet and a passage connecting the inlet and the outlet. The head is located in a housing. The absorption unit also includes a driving unit for sliding the head in the direction of a shaft connected to the head. An end face of the head on the side of the nozzle is in contact with a coating material contained in the nozzle, and the outlet of the head is connected to the nozzle, when the coating operation is performed, while the inlet of the head is connected to a supply opening of the housing.

In such a structure, in order to stop the coating operation, the flow of the coating material from the supply opening of the housing to the inlet of the head is stopped by the sliding movement of the head. Further, the coating material in the nozzle is absorbed into an absorption space to be formed in the absorption unit with the sliding movement of the head, thereby eliminating the coating material from the gap between the nozzle and a roller provided for causing a base member to run. As a result, the coating material is prevented from being pulled out and applied to the base member in accompaniment with the running of the base member. Thus, the leading edge and the trailing edge of coated areas of the base member can be straight lines. Such linearity of the leading edge and the trailing edge of the coated areas is ensured even in the case that the coating material is provided in a large amount such as 100 cc/m$^2$ or more. As a result, each of the coated areas of the base member has high qualities including a satisfactory shape over the entire length from the leading edge to the trailing edge, and thus the whole region of the respective coated areas can be used as a product. Accordingly, the production yield is improved.

In the above examples, an intermittent coating apparatus according to the present invention is used for coating a base member with a paint. The present invention is also applicable for coating the base member or any other coating targets with any other coating materials such as an adhesive or the like.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An intermittent coating apparatus for intermittently coating an external coating target with a coating material, the intermittent coating apparatus comprising:

a nozzle for distributing the coating material toward the coating target;

supply control means for alternatively providing and stopping a flow of the coating material to the nozzle; and absorption control means for absorbing the coating material remaining in the nozzle to a prescribed space when a supply of the coating material stops and for returning the coating material from the prescribed space into the nozzle when the supply of the coating material starts, wherein the supply control means includes a movable section slidable along a guide and a driving unit for controlling the sliding movement of the movable section, the flow of the coating material to the nozzle being alternatively provided and stopped by the sliding movement of the movable section, and the prescribed space is an absorption space formed by the sliding movement of the movable section, the sliding movement of the movable section causing the coating material remaining in the nozzle to be absorbed into the absorption space when the supply of the coating material stops.

2. An intermittent coating apparatus according to claim 1, wherein the coating material is absorbed into the absorption space in an amount corresponding to the volume of the absorption space.

3. An intermittent coating apparatus according to claim 1, wherein the coating target is coated with the coating material in an amount of at least 100 cc/m$^2$.

4. An intermittent coating apparatus according to claim 5, wherein the coating target and a tip of the nozzle has a gap of at least 0.05 mm therebetween.

5. An intermittent coating apparatus for intermittently coating an external coating target with a coating material, the intermittent coating apparatus comprising:

a nozzle for discharging the coating material toward the coating target, the nozzle having therein a slit opened toward the coating target and a manifold connected to the slit;

a head slidable along a guide until an end face thereof reaches the manifold to control a flow of he coating material to the nozzle, the head having an inlet, an outlet, and a passage connecting the inlet and the outlet; and a driving unit for controlling the sliding movement of the head, wherein the inlet of the head is connected to an external supply opening to supply the coating material to the nozzle via the inlet, the passage and the outlet of the head, in order to coat the coating target with the coating material, and the head slides to close the external supply opening with a side wall of the head to thereby stop the supply of the coating material and also to form an absorption space to thereby absorb the coating material remaining in the nozzle into the absorption space, in order to stop coating.

6. An intermittent coating apparatus according to claim 5, wherein the coating material is absorbed into the absorption space in an amount corresponding to the volume of the absorption space.

7. An intermittent coating apparatus according to claim 5, wherein the coating target is coated with the coating material in an amount of at least 100 $cc/m^2$.

8. An intermittent coating apparatus according to claim 7, wherein the coating target and a tip of the nozzle has a gap of at least 0.05 mm therebetween.

* * * * *

UNITED STATES PATENT AND TRADEMARK OFFICE

CERTIFICATE OF CORRECTION

PATENT NO. : 5,536,313

DATED : July 16, 1996

INVENTOR(S) : Masaru Watanabe et al

It is certified that error appears in the above-identified patent and that said Letters Patent is hereby corrected as shown below:

Claim 4, column 8, line 45, change "5" to --3--.

Claim 5, column 8, line 57, change "he" to --the--.

Signed and Sealed this

Twenty-ninth Day of April, 1997

*Attest:*

*Attesting Officer*

BRUCE LEHMAN

*Commissioner of Patents and Trademarks*